US011793700B2

(12) United States Patent
Lu et al.

(10) Patent No.: US 11,793,700 B2
(45) Date of Patent: Oct. 24, 2023

(54) AIRBAG CUSHION ASSEMBLY, INTELLIGENT PRESSURE SORE PREVENTION CUSHION, AND MONITORING SYSTEM

(71) Applicant: SHANGHAI CHUANGSHI INDUSTRY GROUP CO., LTD., Shanghai (CN)

(72) Inventors: Ruzhan Lu, Shanghai (CN); Jue Wang, Shanghai (CN); Tian Liu, Shanghai (CN); Honghong Su, Shanghai (CN); Mingsong Lu, Shanghai (CN); Fangfang Zhu, Shanghai (CN); Litao Fan, Shanghai (CN); Yong You, Shanghai (CN); Yunguang Pan, Shanghai (CN); Yajian Wu, Shanghai (CN); Qihang You, Shanghai (CN)

(73) Assignee: SHANGHAI CHUANGSHI INDUSTRY GROUP CO., LTD., Shanghai (CN)

( * ) Notice: Subject to any disclaimer, the term of this patent is extended or adjusted under 35 U.S.C. 154(b) by 448 days.

(21) Appl. No.: 16/977,092

(22) PCT Filed: Feb. 28, 2020

(86) PCT No.: PCT/CN2020/077061
§ 371 (c)(1),
(2) Date: Aug. 31, 2020

(87) PCT Pub. No.: WO2021/042681
PCT Pub. Date: Mar. 11, 2021

(65) Prior Publication Data

US 2021/0205160 A1 Jul. 8, 2021

(30) Foreign Application Priority Data

Sep. 6, 2019 (CN) ..... 201910843919.X

(51) Int. Cl.
*A61G 7/057* (2006.01)

(52) U.S. Cl.
CPC ..... *A61G 7/05776* (2013.01); *A61G 7/05784* (2016.11); *A61G 2203/34* (2013.01); *A61G 2203/44* (2013.01); *A61G 2203/46* (2013.01)

(58) Field of Classification Search
CPC ..... A61G 7/05776; A61G 7/05784; A61G 2203/34; A61G 2203/44; A61G 2203/46; A61G 7/05769; A61G 5/1045
See application file for complete search history.

(56) References Cited

U.S. PATENT DOCUMENTS 4,982,466 A * 1/1991 Higgins ..... A47C 27/082 5/713
5,052,068 A * 10/1991 Graebe ..... A47C 27/10 297/452.41

(Continued)

FOREIGN PATENT DOCUMENTS

CN 103565165 A 2/2014
CN 103565624 A 2/2014

(Continued)

*Primary Examiner* — Myles A Throop
(74) *Attorney, Agent, or Firm* — Bayramoglu Law Offices LLC

(57) ABSTRACT

An airbag cushion assembly includes an airbag cushion and an inflation-deflation apparatus that communicates with the airbag cushion. The airbag cushion includes a plurality of sub-airbags, and an airbag gap is formed between adjacent sub-airbags. The inflation-deflation apparatus is provided with an exhaust port, the exhaust port is provided in the airbag gap, and the inflation-deflation apparatus is configured to inflate and deflate the airbag cushion. For the airbag cushion assembly, the exhaust port is provided in the airbag gap, air exhausted by the airbag cushion takes away damp air accumulated between a patient and the airbag cushion, to reduce humidity of the contact area between the patient and (Continued)

the airbag cushion, thereby achieving a pressure sore prevention effect.

15 Claims, 10 Drawing Sheets

(56) References Cited

U.S. PATENT DOCUMENTS 5,502,855 A * 4/1996 Graebe ..... A61G 7/05769 5/710
5,590,428 A * 1/1997 Roter ..... A47C 27/081 297/180.13
5,603,133 A * 2/1997 Vrzalik ..... A61G 7/05784 5/609
6,510,573 B1 * 1/2003 Grabe ..... A47G 9/1027 5/490
7,832,798 B2 * 11/2010 Bajic ..... A47C 7/72 297/452.47
8,065,763 B2 * 11/2011 Brykalski ..... A47C 21/044 5/652.2
8,327,478 B2 * 12/2012 Faridoon ..... A47C 31/005 5/724
9,459,597 B2 * 10/2016 Kahn ..... G16H 20/30
2011/0010014 A1 * 1/2011 Oexman ..... F24F 11/63 600/301
2011/0163885 A1 * 7/2011 Poulos ..... A61G 7/05784 5/710
2014/0020185 A1 * 1/2014 Wang ..... A61G 7/05769 5/652.1
2018/0369040 A1 * 12/2018 Sheth ..... A61G 7/05776

FOREIGN PATENT DOCUMENTS

CN 203693959 U 7/2014
CN 103976597 A 8/2014
CN 204698884 U 10/2015
CN 105581879 A 5/2016
CN 205548874 U 9/2016
CN 107174439 A 9/2017
CN 110507496 A 11/2019

* cited by examiner

AIRBAG CUSHION ASSEMBLY, INTELLIGENT PRESSURE SORE PREVENTION CUSHION, AND MONITORING SYSTEM

CROSS REFERENCE TO THE RELATED APPLICATIONS

This application is the national phase entry of International Application No. PCT/CN2020/077061, filed on Feb. 28, 2020, which is based upon and claims priority to Chinese Patent Application No. 201910843919.X, filed on Sep. 6, 2019, the entire contents of which are incorporated herein by reference.

TECHNICAL FIELD

The present invention relates to the technical field of medical devices, and in particular, to an airbag cushion assembly, an intelligent pressure sore prevention cushion, and a monitoring system.

BACKGROUND

Pressure sores, also known as bedsores or pressure ulcers, refer to that local body tissues are pressed in a long term or is stimulated by physical and chemical factors in a long term to cause neurotrophic disorders and blood circulation disorders, and the local tissues continue to suffer from ischemia, hypoxia, and malnutrition, resulting in a loss of normal skin functions, thereby leading to soft tissue degeneration, ulceration, and necrosis. The pressure sores are tissue damage caused by pressing on a local human body and pressing duration exceeding a certain limit.

With development of technologies and health concerns, people have taken many measures and developed many products to prevent pressure sores. For example, there are two types of mattresses: passive and active mattresses, and the same is true for cushions. There are more passive cushions than active cushions. However, air does not flow in an existing cushion, and damp air is not easy to disperse, and is easy to accumulate in the cushion. Therefore, the cushion is relatively moist and does not help prevent pressure sores.

SUMMARY

In view of this, it is necessary to provide an airbag cushion assembly, an intelligent pressure sore prevention cushion, and a monitoring system to resolve a problem that the airbag cushion assembly does not easily disperse damp air after long-term sitting.

An airbag cushion assembly is provided, where the airbag cushion assembly includes an airbag cushion and an inflation-deflation apparatus that communicates with the airbag cushion;

the airbag cushion includes a plurality of sub-airbags, and an airbag gap is formed between adjacent sub-airbags; and the inflation-deflation apparatus is provided with an exhaust port, the exhaust port is provided in the airbag gap, and the inflation-deflation apparatus is configured to inflate and deflate the airbag cushion.

In one of the embodiments, the inflation-deflation apparatus includes an air pump, an inflation-deflation pipe, and an exhaust pipe provided with the exhaust port;

the air pump communicates with the airbag cushion through the inflation-deflation pipe, and is configured to inflate and deflate the airbag cushion; and the exhaust pipe is disposed in the airbag gap, and the inflation-deflation pipe communicates with an external environment through the exhaust pipe.

In one of the embodiments, the airbag cushion is provided with a first-direction airbag gap and a second-direction airbag gap that intersect;

the exhaust pipe is provided with a plurality of exhaust ports; and the exhaust pipe is disposed in the first-direction airbag gap and/or the second-direction airbag gap, and the exhaust port is provided at an intersection of the first-direction airbag gap and the second-direction airbag gap.

In one of the embodiments, the inflation-deflation apparatus further includes a first switch mechanism, and the first switch mechanism is disposed on the exhaust pipe; and the first switch mechanism is configured to open or close the passageway between the airbag cushion and the exhaust pipe.

In one of the embodiments, the inflation-deflation apparatus further includes a second switch mechanism, and the air pump separately communicates with the airbag cushion and the external environment by the second switch mechanism, so that the air pump is capable of inflating or deflating the airbag cushion by the second switch mechanism.

In one of the embodiments, the second switch mechanism includes a first three-way valve and a second three-way valve, and the second switch mechanism has a first state and a second state;

in the first state, the air pump communicates with the external environment by the first three-way valve, the air pump communicates with the airbag cushion by the second three-way valve, and the inflation-deflation apparatus is in an inflating state; and in the second state, the air pump communicates with the airbag cushion by the first three-way valve, the air pump communicates with the exhaust pipe by the second three-way valve, and the inflation-deflation apparatus is in a deflating state.

In one of the embodiments, the airbag cushion includes an inflatable and deflatable airbag region, and the inflatable and deflatable airbag region includes a plurality of airbag sub-regions that do not communicate with each other; the inflation-deflation apparatus further includes a motor and a switching valve connected to the motor, and the motor is configured to drive the switching valve to open the passageway between the air pump and each airbag sub-region.

In one of the embodiments, the switching valve includes a main port and a plurality of auxiliary ports, and the inflation-deflation pipe includes a main pipe communicating with the main port and an auxiliary pipe communicating with the auxiliary port; and the main port of the switching valve communicates with the air pump through the main pipe, and each auxiliary port of the switching valve communicates with the corresponding airbag sub-region through the auxiliary pipe.

An intelligent pressure sore prevention cushion is provided, including the airbag cushion assembly described above, an environment monitoring apparatus, and a control apparatus; the airbag cushion assembly and the environment monitoring apparatus are separately connected to the control apparatus;

the environment monitoring apparatus is configured to collect environmental information; and the control apparatus is configured to control, based on the environmental information, the inflation-deflation apparatus to perform inflation and deflation.

In one of the embodiments, the environment monitoring apparatus includes at least one of a weight sensor, a pressure sensor, a temperature sensor, and a humidity sensor.

In one of the embodiments, the intelligent pressure sore prevention cushion further includes a vital sign monitoring apparatus connected to the control apparatus, where the vital sign monitoring apparatus is configured to monitor vital sign information of a patient, and send the vital sign information to the control apparatus; the control apparatus controls the airbag cushion assembly based on the vital sign information.

A monitoring system is provided, including an intelligent pressure sore prevention cushion described above and an external device;

the intelligent pressure sore prevention cushion is connected to the external device;

the intelligent pressure sore prevention cushion sends the environmental information to the external device; and the external device controls the intelligent pressure sore prevention cushion based on the environmental information.

For the airbag cushion assembly, the intelligent pressure sore prevention cushion, and the monitoring system, the exhaust port of the inflation-deflation apparatus is provided in the airbag gap between the airbag cushions; when the airbag cushion is deflated, air is exhausted through the exhaust port to take away damp air accumulated between a patient and the airbag cushion through the airbag gap, to reduce humidity of the contact area between the patient and the airbag cushion, thereby achieving a pressure sore prevention effect.

DETAILED DESCRIPTION

Figure 1:
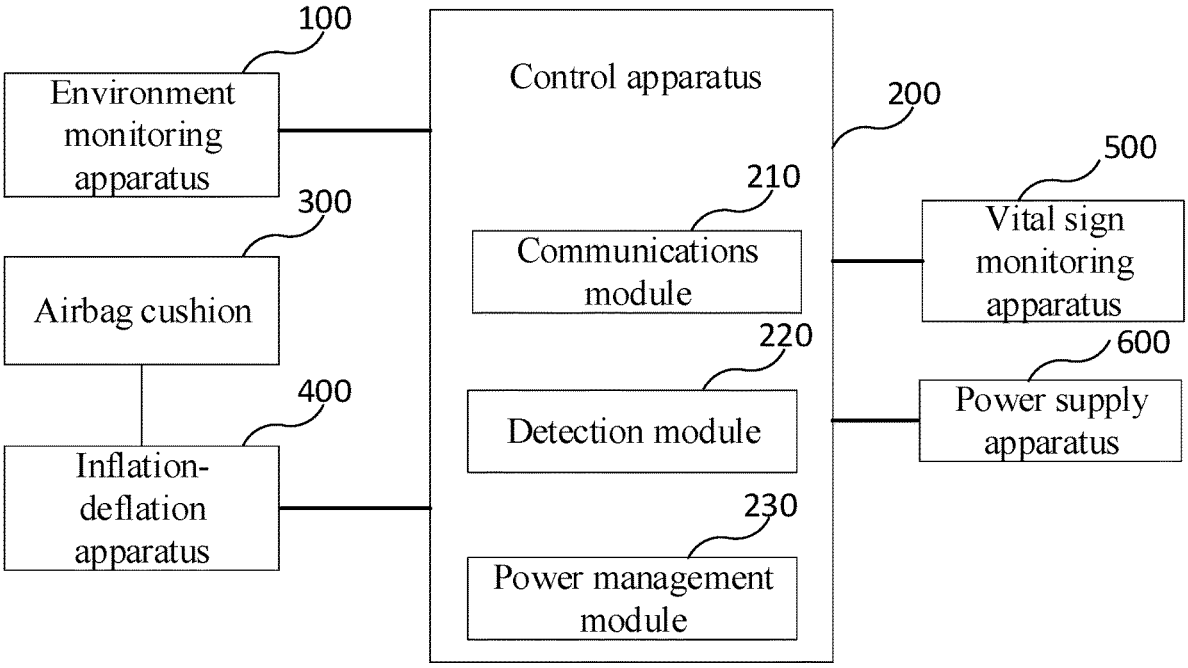
FIG. 1 is a system structural diagram of an intelligent pressure sore prevention cushion according to an embodiment of the present invention.
Figure 2:
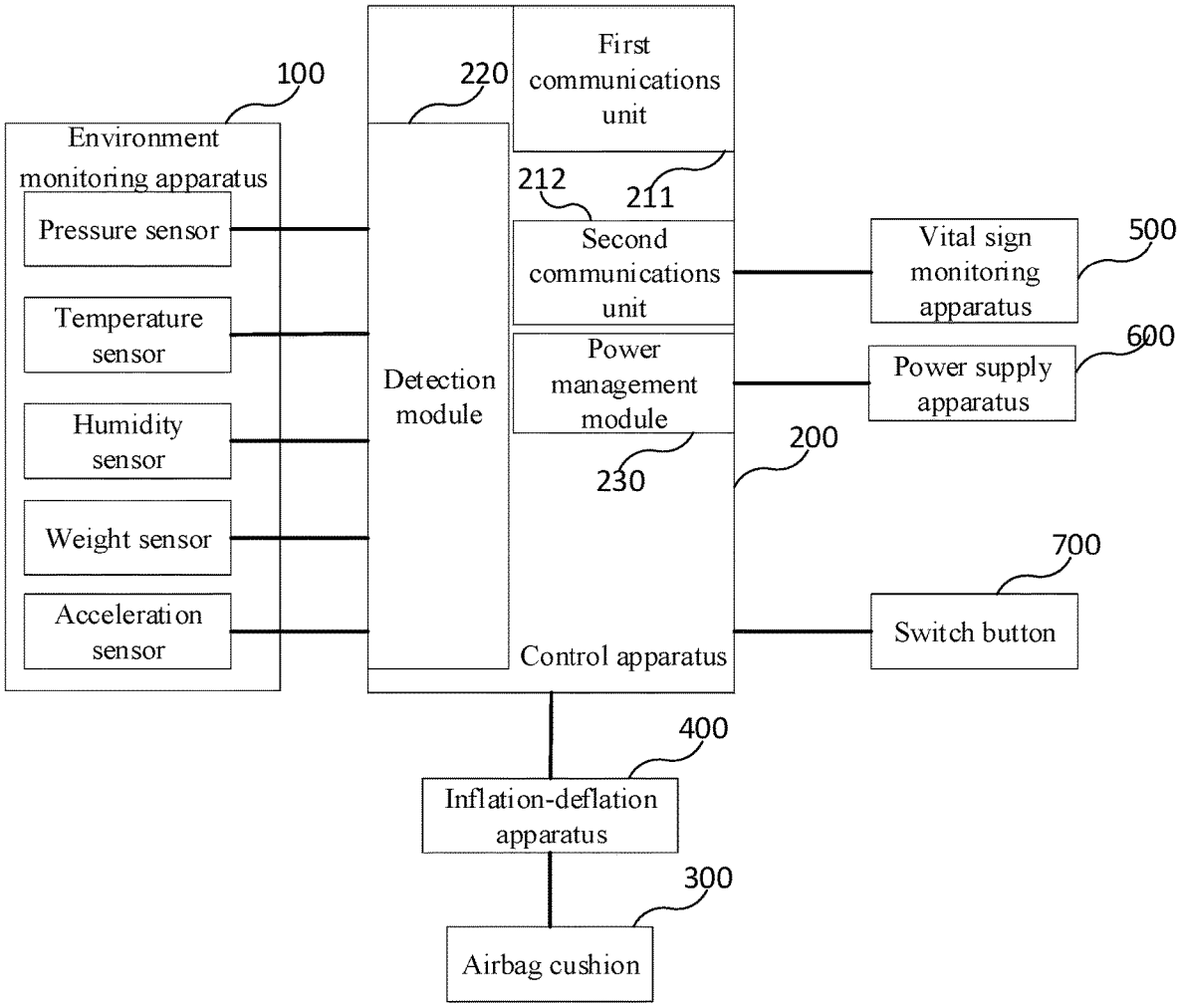
FIG. 2 is system structural diagram of a specific structure of the intelligent pressure sore prevention cushion in FIG. 1.
Figure 3:
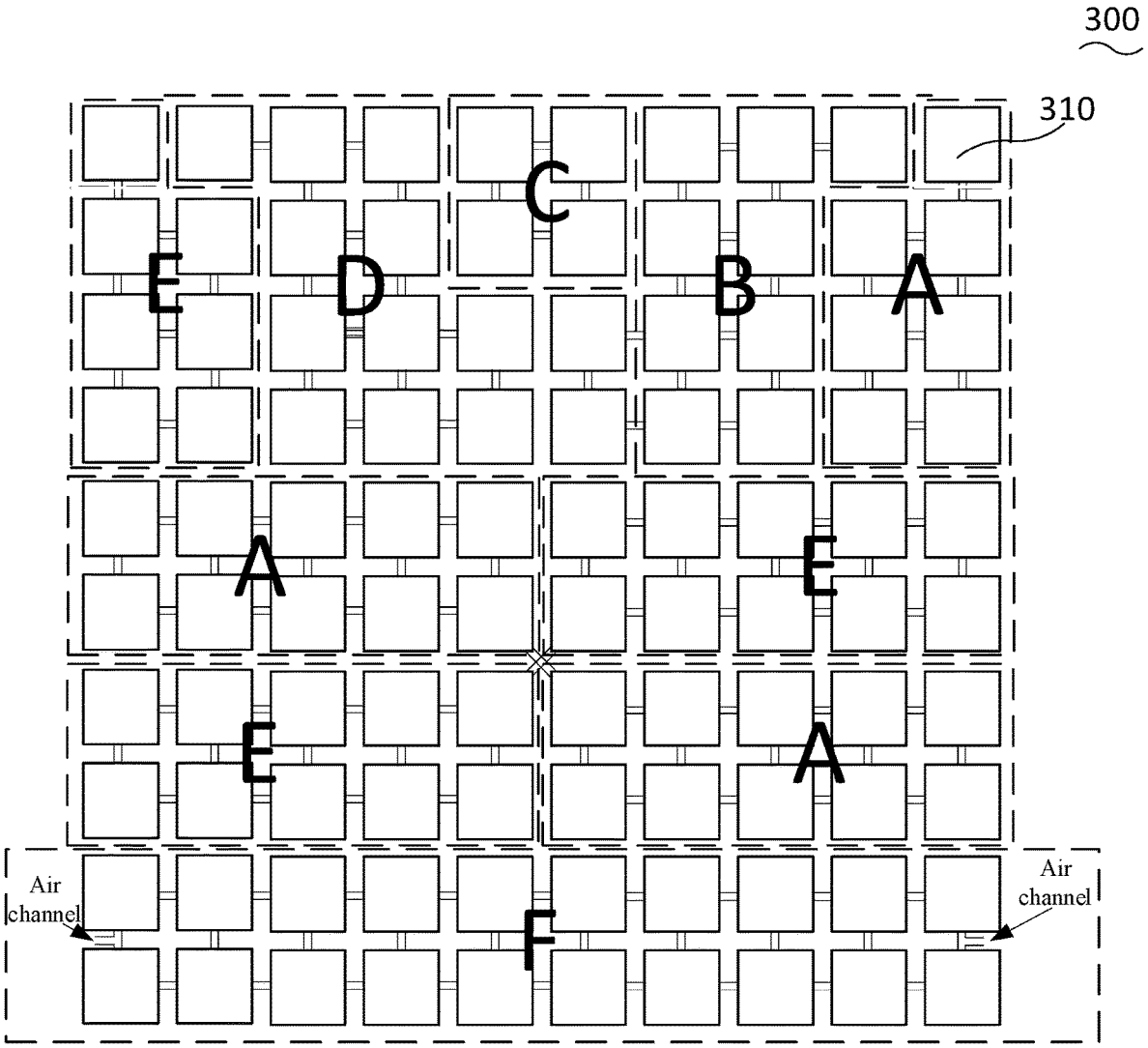
FIG. 3 is a region division diagram of an airbag cushion in FIG. 2.
Figure 4:
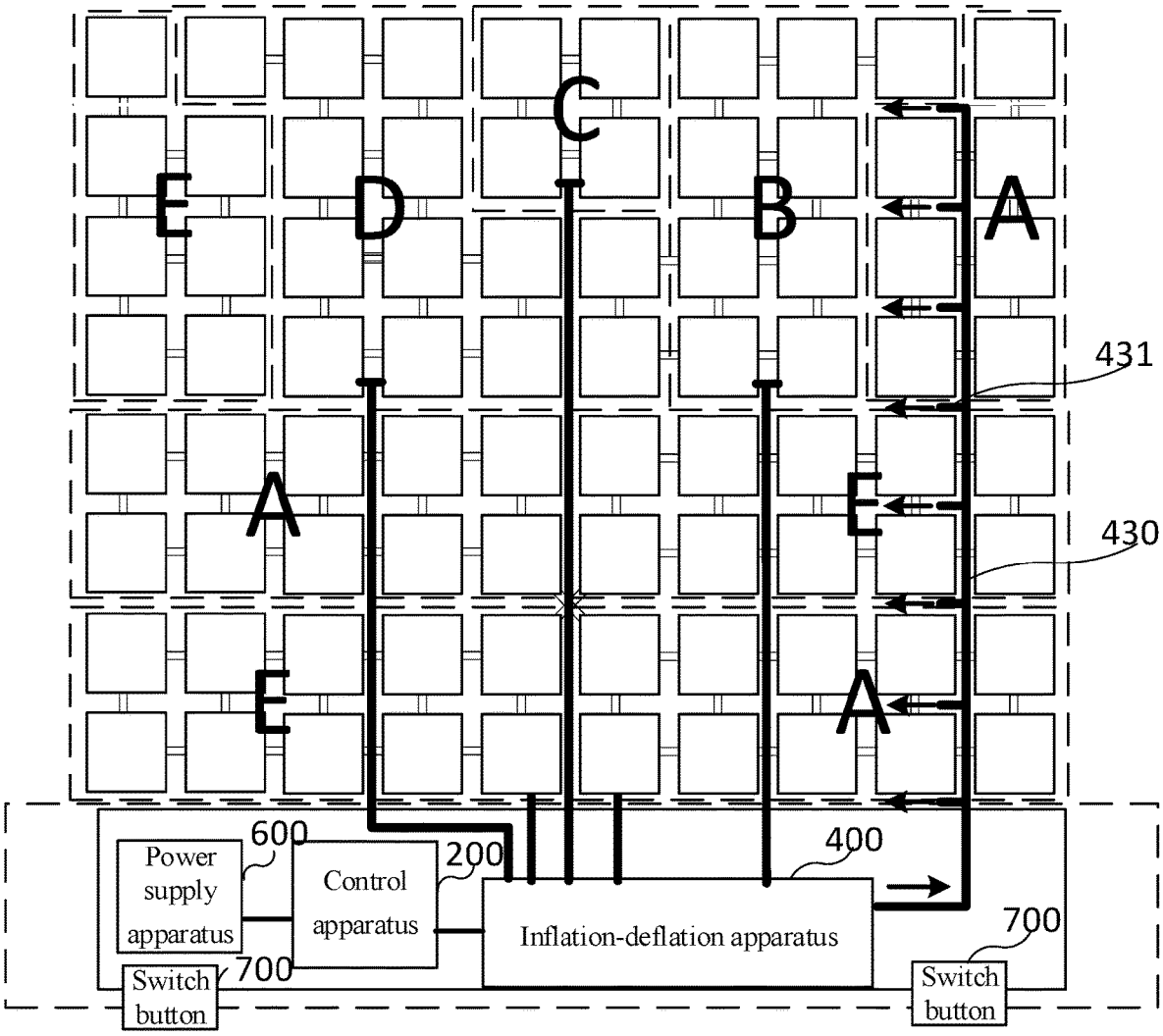
FIG. 4 is a region structural diagram of the intelligent pressure sore prevention cushion in FIG. 1.
Figure 5:
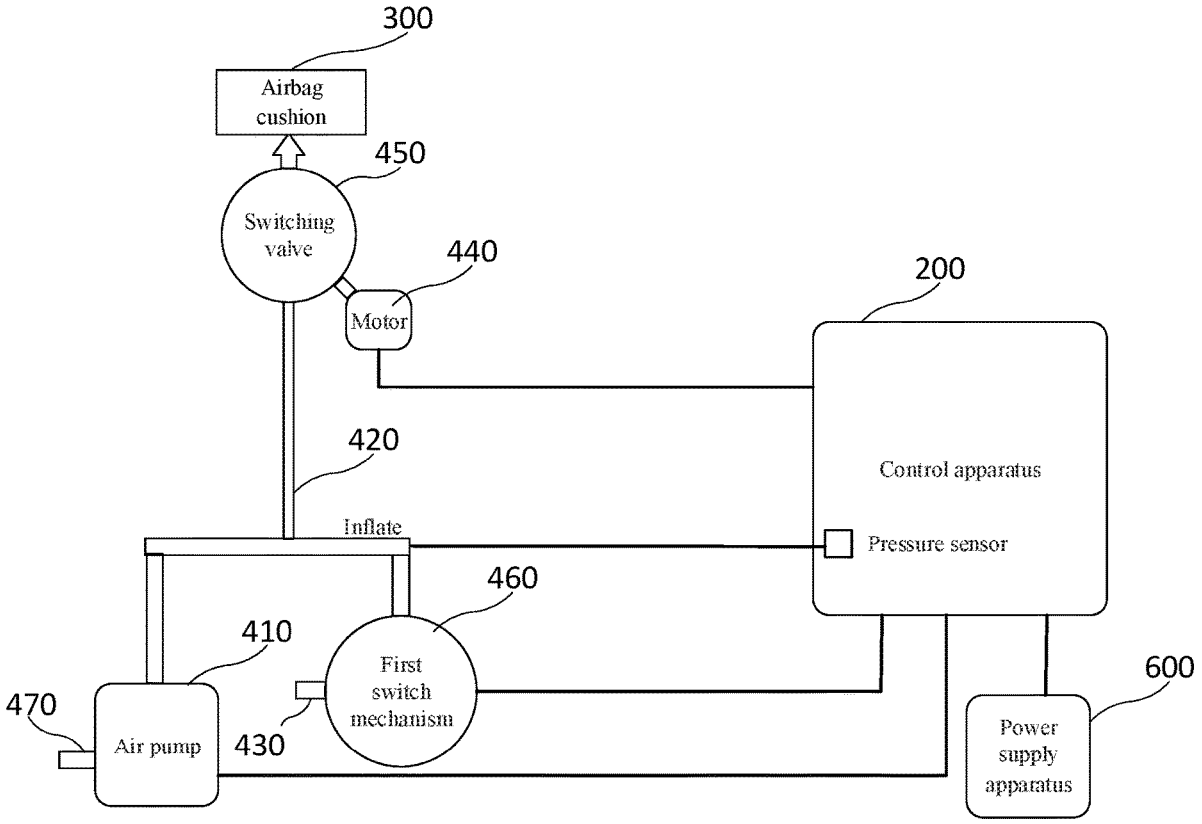
FIG. 5 is a principle diagram of a passive deflation manner according to an embodiment of the present invention.
Figure 6:
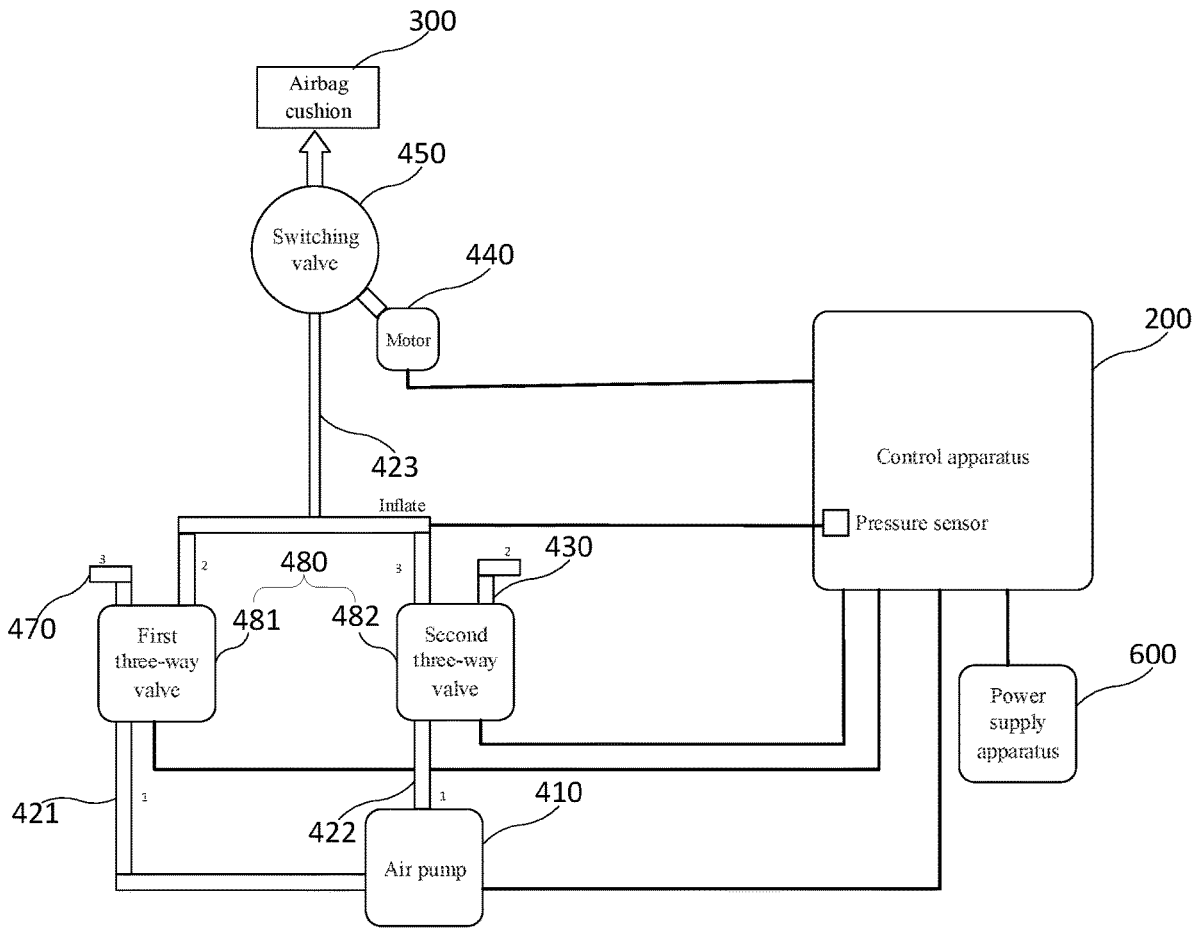
FIG. 6 is a principle diagram of an active deflation manner according to an embodiment of the present invention.
Figure 7:
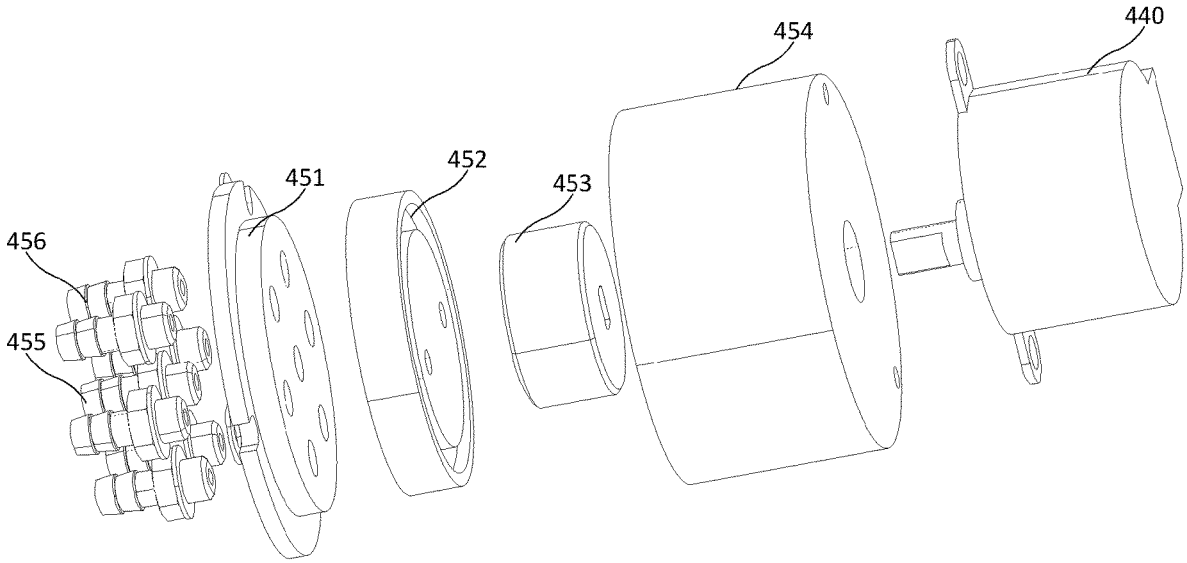
FIG. 7 is an exploded diagram of a structure of a switching valve according to an embodiment of the present invention.
Figure 8:
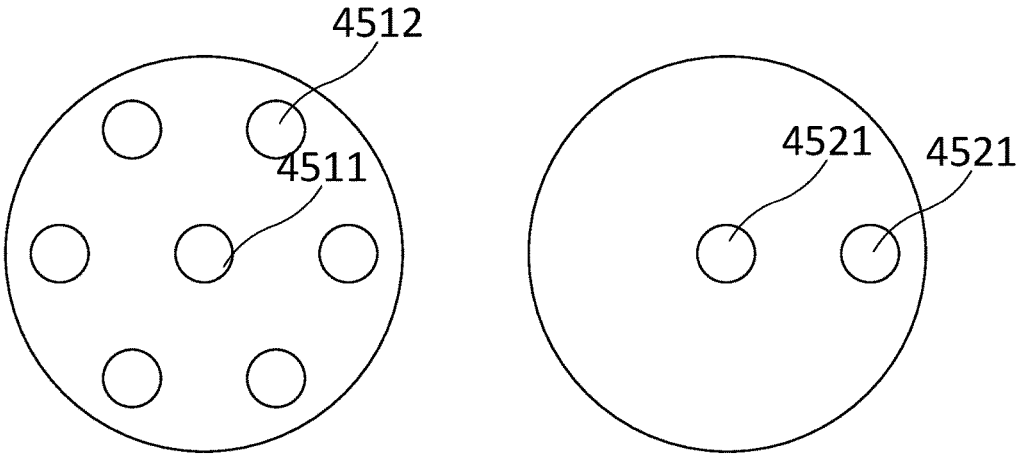
FIG. 8 is a schematic structural diagram of a stator and a rotor in FIG. 7.

To facilitate understanding of the present invention, the present invention is more comprehensively described below with reference to the drawings. Preferred implementations of the present invention are given in the drawings. However, the present invention can be implemented in many different forms, and is not limited to the implementations described in the specification. On the contrary, these implementations are provided to more thoroughly and completely understand the disclosed content of the present invention.

Unless otherwise defined, all technical and scientific terminologies used in the specification have the same meanings as those commonly understood by skilled artisans in the technical field of the present invention. The terminologies used in the specification are only for the purpose of describing specific implementations, and are not intended to limit the present invention. The terminology "and/or" used herein includes any combinations of one or more of the associated listed items.

It should be noted that when one element is referred to as being "fixed" to another element, the element may be directly on another element or an intervening element may also be present. When one element is considered as being "connected" to another element, the element may be directly connected to another element or an intervening element may be present simultaneously. The terminologies "vertical", "horizontal", "left", "right", and similar expressions used in the specification are for illustrative purposes only, and do not indicate a unique implementation.

Pressure sores are a common complication rather than a primary disease in rehabilitation medicine, and are typically injuries caused by inadequate care of other primary diseases. Pressure sores are more common in bedridden or vulnerable patients and usually affect people confined to bed or who sit in a chair or wheelchair for long periods of time. Improving patient care is better prevention of pressure sores. Once pressure sores have formed, the treatment thereof requires significant human, material, and financial resources, which also affects the treatment of major diseases.

In addition to strengthening nutrition, a method for preventing pressure sores is mainly to regularly relieve pressure on severely affected areas, which specifically includes: (1) regularly turning over or changing positions; (2) gently massaging local tissues; (3) keeping the skin clean and dry. This prevention method requires a lot of time for nursing staff. However, due to insufficient nursing resources in China, care measures are often taken when patients have pressure sores, rather than using nursing procedures to find and solve problems of the patient.

As shown in FIG. 1 to FIG. 8, the present invention provides an airbag cushion assembly, configured to adjust the temperature and humidity of the contact area between the patient and the airbag cushion 300.

The airbag cushion assembly includes the airbag cushion 300 and the inflation-deflation apparatus 400 that communicates with the airbag cushion 300. Specifically, the airbag cushion 300 includes a plurality of sub-airbags 310, and an airbag gap is formed between adjacent sub-airbags 310. The inflation-deflation apparatus 400 is configured to inflate and deflate the airbag cushion 300. Optionally, the section of the sub-airbag 310 may be any one selected from the group consisting of a triangle, a quadrangle, a pentagon, or a hexagon. The inflation-deflation apparatus 400 is provided with the exhaust port 431. The exhaust port 431 is provided in the airbag gap. An exhausted air flow takes away, through the airbag gap, damp air accumulated between the patient and the airbag cushion 300, to reduce humidity of the contact area between the patient and the airbag cushion 300. The inflation-deflation apparatus 400 is externally connected to the power supply apparatus 600, and the power supply apparatus 600 supplies electric energy for the operation of the inflation-deflation apparatus 400.

The inflation-deflation apparatus 400 includes the air pump 410, the inflation-deflation pipe 420, and the exhaust pipe 430. The air pump 410 communicates with the airbag cushion 300 through the inflation-deflation pipe 420, and is configured to inflate and deflate the airbag cushion 300. The exhaust pipe 430 is provided with the exhaust port 431. The exhaust pipe 430 is provided in the airbag gap. The airbag cushion 300 communicates with the exhaust pipe 430 through the inflation-deflation pipe 420, and the exhaust pipe 430 communicates with an external environment. Specifically, an air outlet port of the air pump 410 communicates with the inflation-deflation pipe 420, to deliver air into the airbag cushion 300. The exhaust pipe 430 communicates with the airbag cushion 300 through the inflation-deflation pipe 420. When the airbag cushion 300 is deflated, the air in the airbag cushion 300 is exhausted to the external environment through the exhaust pipe 430.

The airbag cushion 300 is provided with a first-direction airbag gap and a second-direction airbag gap that intersect. The exhaust pipe 430 is provided with a plurality of exhaust ports 431. The exhaust pipe 430 is disposed in the first-direction airbag gap and/or the second-direction airbag gap, and the exhaust port 431 is provided at an intersection of the first-direction airbag gap and the second-direction airbag gap. In an embodiment, the first-direction airbag gap is a horizontal airbag gap, and the second-direction airbag gap is a vertical airbag gap. The exhaust pipe 430 extends into the horizontal airbag gap and/or the vertical airbag gap. The exhaust port 431 is provided at an intersection of the horizontal airbag gap and the vertical airbag gap. The exhaust pipe 430 is a rigid pipe and linearly disposed in the vertical airbag gap of the airbag cushion 300. The exhaust port 431 is provided at the intersection of the vertical airbag gap and each horizontal airbag gap. Optionally, the exhaust pipe 430 may also be linearly disposed in the horizontal airbag gap of the airbag cushion 300, and the exhaust port 431 is provided at the intersection of the horizontal airbag gap and each vertical airbag gap. The exhaust pipe 430 may also be distributed in the horizontal airbag gap and the vertical airbag gap in a bent manner. When the airbag cushion 300 is deflated, the exhaust port 431 is provided in the airbag gap, and exhausted air is blown to the contact area between the patient and the airbag cushion 300. Alternatively, the exhausted air is blown along the airbag gap to the edge of the airbag cushion 300, and the exhausted airflow takes away high-temperature and high-humidity air between the patient and the airbag cushion 300. Also, the temperature and humidity of intake air of the air pump 410 may be further controlled to control the temperature and humidity of the exhausted air, so as to control the temperature and humidity of the airbag cushion 300. The exhaust port 431 is provided in the airbag gap of the airbag cushion 300 to take away damp air accumulated between the patient and the airbag cushion 300, so as to reduce humidity of the contact area between the patient and the airbag cushion 300, thereby achieving a pressure sore prevention effect.

The inflation-deflation apparatus 400 further includes the air inlet pipe 470. The air inlet pipe 470 communicates with an air inlet port of the air pump 410, and the air pump 410 delivers external air into the airbag cushion 300 through the air inlet pipe 470. Optionally, the air pump 410 may also directly deliver external air into the airbag cushion 300 through the air inlet port without the air inlet pipe 470.

The inflation-deflation apparatus 400 includes at least one of a passive deflation structure and an active deflation structure.

In one of the embodiments, the inflation-deflation apparatus 400 uses the passive deflation structure. For the passive deflation, the air in the airbag is exhausted according to the principle that pressure in a region airbag is greater than ambient pressure. The passive deflation structure is specifically described as follows: The inflation-deflation apparatus 400 further includes the first switch mechanism 460, the first switch mechanism 460 is disposed on the exhaust pipe 430, and the first switch mechanism 460 is configured to open or close the passageway between the airbag cushion 300 and the exhaust pipe 430. The first switch mechanism 460 is an on-off valve, and the on-off valve is controlled to be opened or closed to open or close the passageway between the inflation-deflation pipe 420 and the exhaust pipe 430. In an embodiment, the on-off valve has a first valve port and a second valve port. The first valve port is connected to the inflation-deflation pipe 420, and the second valve port is connected to the exhaust pipe 430. When the on-off valve is opened, the pressure of air in the airbag cushion 300 is greater than the ambient pressure, so that the air in the airbag is exhausted. When the on-off valve is closed, the air in the airbag cushion 300 is prevented from being exhausted.

In one of the embodiments, the inflation-deflation apparatus 400 uses the active deflation structure. For the active deflation, the air inlet port and the air outlet port of the air pump 410 cooperate with a three-way valve to perform active deflation, and air in the airbag cushion 300 is extracted by the air pump 410 to accelerate the deflation. The active deflation structure is specifically described as follows: The inflation-deflation apparatus 400 further includes the second switch mechanism 480, and the air pump 410 separately communicates with the airbag cushion 300 and the external environment by the second switch mechanism 480. Specifically, the air pump 410 separately communicates with the air inlet pipe 470 and the external environment, and the switching valve 450 and the airbag cushion 300 by the second switch mechanism 480. Alternatively, the air pump 410 separately communicates with the switching valve 450 and the airbag cushion 300, and the exhaust pipe 430 and the external environment by the second switch mechanism 480, so that the air pump 410 can inflate or deflate the airbag cushion 300 by the second switch mechanism 480. In an embodiment, the second switch mechanism 480 includes the first three-way valve 481 and the second three-way valve 482. The second switch mechanism 480 has a first state and a second state. In the first state, the air pump 410 communicates with the external environment by the first three-way valve, the air pump 410 communicates with the airbag cushion 300 by the second three-way valve, and the inflation-deflation apparatus 400 is in an inflating state. In the second state, the air pump 410 communicates with the airbag cushion 300 by the first three-way valve, the air pump 410 communicates with the exhaust pipe 430 by the second three-way valve, and the inflation-deflation apparatus 400 is in a deflating state. Specifically, each of the first three-way valve 481 and the second three-way valve 482 has a first valve port, a second valve port, and a third valve port. The inflation-deflation pipe 420 includes the first inflation-deflation pipe 421, the second inflation-deflation pipe 422, and the third inflation-deflation pipe 423. In the first three-way valve 481, the first valve port communicates with the first inflation-deflation pipe 421, the second valve port communicates with the third inflation-deflation pipe 423, and the third valve port communicates with the air inlet pipe 470. In the second three-way valve 482, the first valve port communicates with the second inflation-deflation pipe 422, the second valve port communicates with the exhaust pipe 430, and the third valve port communicates with the third inflation-deflation pipe 423. When the second switch mechanism 480 is in the first state, the first inflation-deflation pipe 421 communicates with the air inlet pipe 470 by the first three-way valve 481, the second inflation-deflation pipe 422 communicates with the third inflation-deflation pipe 423 by the second three-way valve 482, and the inflation-deflation apparatus 400 is in an inflating state to inflate the airbag cushion 300. When the second switch mechanism 480 is in the second state, the first inflation-deflation pipe 421 communicates with the third inflation-deflation pipe 423 by the first three-way valve 481, the second inflation-deflation pipe 422 communicates with the exhaust pipe 430 by the second three-way valve 482, and the inflation-deflation apparatus 400 is in a deflating state to deflate the airbag cushion 300. More specifically, each of the first three-way valve 481 and the second three-way valve 482 is a two-position three-way solenoid valve, and has two states: a power-on state and a power-off state. When the first three-way valve 481 and the second three-way valve 482 are in the power-on state, the inflation-deflation apparatus 400 inflates the airbag cushion 300. When the first three-way valve 481 and the second three-way valve 482 are in the power-off state, the inflation-deflation apparatus 400 deflates the airbag cushion 300.

The airbag cushion 300 includes: an inflatable and deflatable airbag region and a non-inflatable and non-deflatable airbag region. The inflatable and deflatable airbag region includes a plurality of airbag sub-regions that do not communicate with each other, and the plurality of airbag sub-regions separately communicate with the pipe of the inflation-deflation apparatus 400. The inflation-deflation apparatus 400 further includes the motor 440 and the switching valve 450 connected to motor 440. The switching valve 450 includes the main port 455 and a plurality of auxiliary ports 456. The inflation-deflation pipe 420 includes a main pipe (not shown) and a plurality of auxiliary pipes (not shown). The main port 455 of the switching valve 450 communicates with the main pipe, and each auxiliary port 456 of the switching valve 450 communicates with the corresponding auxiliary pipe. Specifically, the main port 455 of the switching valve 450 communicates with the air pump 410 through the main pipe, each auxiliary port 456 of the switching valve 450 communicates with the corresponding airbag sub-region through the auxiliary pipe, and the switching valve 450 is driven by the motor 440 to open the passageway between the main port 455 and different auxiliary ports 456, so that the air pump 410 communicates with the corresponding airbag sub-region, which facilitates inflation and deflation adjustment on different airbag sub-regions, and reduces the power consumption, size, and weight. The airbag cushion assembly inflates or deflates each airbag sub-region by the air pump 410 communicating with different airbag sub-regions, to adjust the air pressure of each airbag sub-region, so that the weight of the patient is evenly distributed by the sub-airbag 310 of the airbag cushion region in contact with buttocks. In an embodiment, the airbag cushion assembly is connected to the control apparatus 200, and the control apparatus 200 is provided with a pressure sensor configured to collect air pressure of the inflation-deflation pipe 420. The control apparatus 200 is separately connected to the motor 440 and the air pump 410. The control apparatus 200 adjusts, based on the air pressure collected by the pressure sensor, an air delivery rate of the air pump 410, and/or adjusts the air pressure of each airbag sub-region by controlling the motor 440 to drive the switching valve 450 to open the passageway between the air pump 410 and the corresponding airbag sub-region.

In an embodiment, the switching valve 450 includes the stator 451, the rotor 452, the connector 453, and the housing 454. One end of the housing 454 is connected to the stator 451, and a rotating shaft of the motor 440 passes through the other end of the housing 454 and is connected to the connector 453. An accommodation cavity is formed between the housing 454 and the stator 451 to accommodate the rotor 452 and the connector 453. The stator 451 and the rotor 452 abut against each other. The housing 454 further includes a sealing member. The sealing member is sleeved outside the connector 453. The rotor 452 is fixedly connected to the connector 453, and the sealing member presses the rotor 452 to enhance air tightness. The stator 451 and the rotor 452 are both made of metal materials, but not limited thereto. Specifically, the stator 451 is provided with one main through-hole 4511 and a plurality of auxiliary through-holes 4512. The main through-hole 4511 communicates with the main port 455, and the auxiliary through-hole 4512 communicates with the auxiliary port 456. The plurality of auxiliary through-holes 4512 are formed around the main through-hole 4511. The main through-hole 4511 and each auxiliary through-hole 4512 are each provided with a thread and parallel to each other. The main through-hole 4511 and the auxiliary through-hole 4512 both have air inlet and outlet functions. The rotor 452 is provided with the communication channel 4521, whereby the main through-hole 4511 communicates with the auxiliary through-hole 4512. The communication channel 4521 may be a groove or hole structure. The motor 440 drives, by the connector 453, the rotor 452 to rotate. The communication channel 4521 of the rotor 452 may allow the main through-hole 4511 of the stator 451 to communicate with different auxiliary through-holes 4512, to inflate or deflate different airbag sub-regions of the airbag cushion 300. When the inflation-deflation apparatus 400 performs inflation, the air in each of the side of the rotor 452 close to the stator 451 and the side close to the connector 453 is under high pressure, so that the pressures cancel each other, which reduces the requirements for structural sealing. The inflation-deflation apparatus 400 inflates and deflates the plurality of airbag sub-regions of the inflatable and deflatable airbag region only by one switching valve 450, which reduces the power consumption, size, and weight of the inflation-deflation apparatus 400. In an embodiment, a 30° included angle is formed between the main through-hole 4511 and the auxiliary through-hole 4512 of the stator 451. Optionally, the included angle may also be 60°, 90°, 120°, 150°, 180°, or another degree.

For the airbag cushion assembly, the exhaust port 431 of the exhaust pipe 430 is provided in the airbag gap. In this way, when the airbag cushion 300 is deflated, air is exhausted from the exhaust port 431 to take away damp air accumulated between the patient and the airbag cushion 300, so as to reduce humidity of the contact area between the patient and the airbag cushion 300, thereby achieving a pressure sore prevention effect.

The present invention provides the intelligent pressure sore prevention cushion 10. A patient sits on the intelligent pressure sore prevention cushion 10, and adjusts air pressure in an inflatable and deflatable airbag region of the airbag cushion 300 based on environmental information, to adjust a stress point of local tissues of the patient, thereby achieving a pressure sore prevention effect.

The intelligent pressure sore prevention cushion 10 includes: the airbag cushion assembly described above, the environment monitoring apparatus 100, and the control apparatus 200. The airbag cushion assembly includes the airbag cushion 300 and the inflation-deflation apparatus 400 that communicates with the airbag cushion 300. The airbag cushion 300 communicates with a pipe of the inflation-deflation apparatus 400. The inflation-deflation apparatus 400 and the environment monitoring apparatus 100 are separately electrically connected to the control apparatus 200. The inflation-deflation apparatus 400 and the control apparatus 200 are accommodated in the airbag cushion 300. Specifically, the environment monitoring apparatus 100 is configured to collect the environmental information, and send the environmental information to the control apparatus 200. The control apparatus 200 is configured to control, based on the environmental information, the inflation-deflation apparatus 400 to perform inflation or deflation. The control apparatus 200 includes the detection module 220 connected to the environment monitoring apparatus 100, and the detection module 220 is configured to analyze the environmental information sent by the environment monitoring apparatus 100. In an embodiment, the control apparatus 200 analyzes the environmental information to determine whether the environmental information falls within a preset range. If the environmental information falls outside the preset range, the control apparatus 200 controls the inflation-deflation apparatus 400 to inflate or deflate the airbag cushion 300, or to adjust the frequency of inflating or deflating the airbag cushion 300. If the environmental information falls within the preset range, the control apparatus 200 controls the inflation-deflation apparatus 400 to stop inflation or deflation, or to inflate or deflate the airbag cushion 300 at a preset frequency. The environment monitoring apparatus 100 includes at least one selected from the group consisting of a weight sensor, a pressure sensor, a temperature sensor, and a humidity sensor. In an embodiment, the environmental information includes the weight of a patient detected by the weight sensor, the pressure detected by the pressure sensor in the airbag cushion 300, the air temperature between the patient and the airbag cushion 300 detected by the temperature sensor, and the air humidity between the patient and the airbag cushion 300 detected by the humidity sensor. In another embodiment, the environment monitoring apparatus 100 further includes a gyroscope, and the gyroscope is configured to detect a direction angle of the intelligent pressure sore prevention cushion 10 to determine a sitting posture of the patient.

The airbag cushion 300 communicates with the pipe of the inflation-deflation apparatus 400. The inflation-deflation apparatus 400 is electrically connected to the control apparatus 200, and the inflation-deflation apparatus 400 is configured to inflate or deflate the airbag cushion 300 under the control of the control apparatus 200. Specifically, the airbag cushion 300 includes a plurality of sub-airbags 310, and the inflation-deflation apparatus 400 is connected to the plurality of sub-airbags 310 to inflate or deflate the plurality of sub-airbags 310. Furthermore, each airbag sub-region has different airbag heights, and the airbag cushion 300 has an uneven surface after being inflated, and the height of the airbag is designed to match the pressure distribution between human buttocks and the airbag cushion 300. In an embodiment, the environment monitoring apparatus 100 includes the weight sensor and the pressure sensor, and is configured to collect weight information of the patient and air pressure in the sub-airbag 310. The control apparatus 200 analyzes the weight information to obtain a target pressure of each sub-airbag 310 corresponding to the weight information. The control apparatus 200 controls the inflation-deflation apparatus 400 based on the target pressure to inflate or deflate the airbag cushion 300, so as to adjust the air pressure in the airbag cushion 300 to the corresponding target pressure. In this way, the weight of the patient is evenly distributed by the sub-airbag 310 of the airbag cushion region in contact with buttocks. Optionally, the weight information may also be preset in the control apparatus 200, and the control apparatus 200 adjusts the air pressure in the airbag cushion 300 based on the preset weight information. In another embodiment, the environment monitoring apparatus 100 includes the temperature sensor and the humidity sensor, and is configured to collect temperature information and humidity information of air between the patient and the airbag cushion 300. The control apparatus 200 adjusts, based on the temperature information and the humidity information, the frequency of inflating or deflating the airbag cushion 300, and adjusts the temperature and humidity of the air between the patient and the airbag cushion 300 by increasing or decreasing the outflow of air released by the airbag cushion 300 and deflation frequency, so that the buttocks are in the desired environment with appropriate temperature and humidity. In still another embodiment, the environment monitoring apparatus 100 is the gyroscope. The patient sits on the intelligent pressure sore prevention cushion 10, a direction angle is measured and obtained through the gyroscope, and the direction angle is analyzed. If the direction angle meets a preset tumbling threshold, a tumbling alarm is sent.

The airbag cushion 300 includes: an inflatable and deflatable airbag region and a non-inflatable and non-deflatable airbag region. The inflatable and deflatable airbag region includes a plurality of airbag sub-regions that do not communicate with each other, and the plurality of airbag sub-regions separately communicate with the pipe of the inflation-deflation apparatus 400. The airbag cushion 300 is divided into six regions: A region, B region, C region, D region, E region, and F region. The A, B, C, D, and E regions are inflatable and deflatable airbag regions, and the F region is a non-inflatable and non-deflatable airbag region. The sub-airbags 310 in each airbag sub-region of the A, B, C, D, and E regions communicate with each other. The pressure sensor monitors the air pressure of the sub-airbag 310 when the sub-airbag 310 in each region is inflated and deflated, to determine the time for stopping inflation and deflation. The sub-airbag 310 in the F region does not have an inflatable-deflatable function. In this way, the airbag cushion 300 has a simple structure, thereby reducing the costs and failure rate. In another embodiment, all the A, B, C, D, E, and F regions are inflatable and deflatable airbag regions, and have an inflatable-deflatable function. The sub-airbags 310 in each airbag sub-region of the A, B, C, D, E, and F regions communicate with each other, each region communicates with the pipe of the inflation-deflation apparatus 400, and the pressure sensor monitors the air pressure of the sub-airbag 310 when the sub-airbag 310 in each region is inflated and deflated, to determine the time for stopping inflation and deflation. The quantity of the airbag sub-regions is not limited, and may be properly designed based on practical requirements.

In an embodiment, the control apparatus 200 is disposed below an airbag in a non-inflatable and non-deflatable airbag region. The control apparatus 200 and the airbag cushion 300 are integrally formed into a single unit to enhance the portability of the intelligent pressure sore prevention cushion 10, which is conductive to reducing the size and weight of the intelligent pressure sore prevention cushion 10 and reducing noise and vibration. In another embodiment, both the inflation-deflation apparatus 400 and the control apparatus 200 are disposed below an airbag of a non-inflatable and non-deflatable airbag region. Optionally, the inflation-deflation apparatus 400 and the control apparatus 200 may also be disposed on the left side or the right side of the non-inflatable and non-deflatable airbag region.

The inflation-deflation apparatus 400 includes the air pump 410, the motor 440, the switching valve 450, and the inflation-deflation pipe 420. The air pump 410 and the motor 440 are separately electrically connected to the control apparatus 200. The motor 440 is mechanically connected to the switching valve 450. The air pump 410 separately communicates with a plurality of airbag sub-regions through the switching valve 450 and the inflation-deflation pipe 420. The control apparatus 200 controls the motor 440 to drive the switching valve 450 to open the passageway between the air pump 410 and each airbag sub-region. The air pump 410 is configured to inflate or deflate each airbag sub-region under the control of the control apparatus 200. Specifically, the control apparatus 200 adjusts the airbag cushion 300 for inflation or deflation based on the environmental information, and controls the rotation of a rotating shaft of the motor 440, to drive a rotor of the switching valve 450 to rotate, so as to switch between the inflation-deflation pipes 420 to control each airbag sub-region to be inflated or deflated, thereby adjusting a stress point of local tissues of the patient. In an embodiment, the control apparatus 200 adjusts, based on the temperature and humidity obtained by the temperature sensor and the humidity sensor, an interval or frequency at which the inflation-deflation apparatus 400 inflates or deflates the airbag cushion 300, to increase or decrease the temperature and humidity of the air between the patient and the intelligent pressure sore prevention cushion 10.

The control apparatus 200 adjusts the interval and/or frequency at which the inflation-deflation apparatus 400 inflates or deflates the airbag cushion 300, to increase or decrease the temperature and humidity of the air between the patient and the intelligent pressure sore prevention cushion 10. Specifically, when the temperature and humidity is greater than a preset temperature and humidity range, the control apparatus 200 shortens the interval and/or frequency at which the inflation-deflation apparatus 400 inflates or deflates the airbag cushion 300, thereby accelerating circulation of the air between the patient and the intelligent pressure sore prevention cushion 10. When the temperature and humidity is less than the preset temperature and humidity range, the control apparatus 200 prolongs the interval and/or frequency at which the inflation-deflation apparatus 400 inflates or deflates the airbag cushion 300, thereby slowing down the circulation of the air between the patient and the intelligent pressure sore prevention cushion 10. The control apparatus 200 adjusts the temperature and humidity of the air between the patient and the intelligent pressure sore prevention cushion 10 by adjusting the interval and/or frequency of inflation and deflation.

The switching valve 450 has two reset modes: a direct reset mode and an indirect reset mode. Specifically, in the direct reset mode, a photoelectric sensor, a magnetic sensor, or the like is configured to detect a reset position mark to implement a reset function. When the reset position mark is detected, rotation is stopped to complete the reset process. In an embodiment, the direct reset mode is achieved by the photoelectric sensor. A metal baffle is disposed at a reset position and used as the reset mark. When the photoelectric sensor approaches the metal baffle, the detected optical signal changes, and the photoelectric sensor generates a signal and sends the signal to the control apparatus 200. The control apparatus 200 controls the motor 440 to stop rotating to complete the reset process. In another embodiment, the direct reset mode is achieved by the magnetic sensor. A metal baffle is disposed at the reset position and used as the reset mark. When the magnetic sensor approaches the metal baffle, the detected magnetic field signal changes, and the magnetic sensor generates a signal and sends the signal to the control apparatus 200. The control apparatus 200 controls the motor 440 to stop rotating to complete the reset process.

Specifically, in the indirect reset mode, the pressure sensor is configured to detect the pressure in a channel to implement the reset function. The process thereof is as follows: The air pump 410 starts to work after being turned on, and the control apparatus 200 reads a pressure value of the pressure sensor. If the pressure value is greater than a specified value, it is determined that the position of the stator 451 is the reset position. If the pressure value is less than the specified value, the switching valve 450 starts to rotate at a certain speed. When the pressure value detected by the pressure sensor is greater than the specified value, the switching valve 450 stops rotating, and the position of the stator 451 is the reset position of the switching valve 450.

The inflation-deflation apparatus 400 further includes a vibration absorbing member. The vibration absorbing member is connected to the air pump 410, and is configured to reduce the vibration generated during operation of the air pump 410. Specifically, the vibration absorbing member includes a primary vibration absorbing member and a secondary vibration absorbing member. The primary vibration absorbing member is connected to the air pump 410, to reduce the vibration generated during the operation of the air pump 410. The secondary vibration absorbing member accommodates the air pump 410, to reduce vibration and noise generated during the operation of the air pump 410. In an embodiment, the primary vibration absorbing member is a spring, and the secondary vibration absorbing member is silencing cotton or vibration isolation cotton.

The control apparatus 200 is provided with a switch button, and the switch button is configured to start or stop the control apparatus 200. Specifically, the switch button is provided with an indicator light, and the indicator light is controlled by the control apparatus 200, to flash at a certain frequency. In an embodiment, the quantity of the switch buttons is two, and the switch buttons are respectively located on two sides of the control apparatus 200, so that the patient can conveniently start or stop the intelligent pressure sore prevention cushion 10.

The control apparatus 200 is further provided with an alarm module, and the alarm module is configured to send an alarm prompt. Specifically, the alarm prompt may be a sound prompt, a light prompt, or other prompt. In an embodiment, the alarm module is an acousto-optic alarm, and the control apparatus 200 analyzes environmental information and controls the acousto-optic alarm to send an acousto-optic alarm when the environmental information exceeds a preset safety range.

The intelligent pressure sore prevention cushion 10 further includes the power supply apparatus 600. The power supply apparatus 600 is connected to the environment monitoring apparatus 100, the inflation-deflation apparatus 400, and the control apparatus 200, and is configured to supply electric energy to the environment monitoring apparatus 100, the inflation-deflation apparatus 400, and the control apparatus 200. In an embodiment, the power supply apparatus 600 is a lithium ion rechargeable battery, and is accommodated in the airbag cushion 300. Optionally, the power supply apparatus 600 may also be a nickel-cadmium rechargeable battery, a nickel-metal hydride battery, a lead storage battery, a lithium iron phosphate rechargeable battery, or other rechargeable batteries. In another embodiment, the power supply apparatus 600 is a lithium ion rechargeable battery, and is installed outside the airbag cushion 300.

The control apparatus 200 further includes the power management module 230 electrically connected to the power supply apparatus 600. Specifically, the power management module 230 is configured to distribute electric energy to the environment monitoring apparatus 100, the inflation-deflation apparatus 400, and the control apparatus 200, and obtain a battery percentage of the power supply apparatus 600. When the battery percentage is lower than a preset battery percentage threshold, the frequency of inflating or deflating the airbag cushion 300 is adjusted by the power management module 230. The battery percentage threshold includes a battery low threshold and an adjustment threshold. The duration of use of the intelligent pressure sore prevention cushion 10 is optimized and prolonged under a certain battery percentage. If the battery percentage is lower than a preset adjustment threshold, the control apparatus 200 adjusts an interval or frequency of inflating or deflating the airbag cushion 300. If the battery percentage is lower than a preset battery low threshold, the control apparatus 200 controls the inflation-deflation apparatus 400 to inflate the airbag cushion 300, enters a standby mode after the airbag cushion is inflated, and sends a low-pressure alarm. In an embodiment, the adjustment threshold is 30%, and the battery low threshold is 10%. When the battery percentage of the power supply apparatus 600 is lower than 30%, the control apparatus 200 controls the inflation-deflation apparatus 400 to prolong the interval of inflating or deflating the inflatable and deflatable airbag region of the airbag cushion 300, to reduce the inflation-deflation frequency. When the battery percentage of the power supply apparatus 600 is lower than 10%, the control apparatus 200 controls the inflation-deflation apparatus 400 to inflate the inflatable and deflatable airbag region of the airbag cushion 300, enters the standby mode after the inflatable and deflatable airbag region is inflated, and controls the indicator light on the switch button to send a flashing alarm indicating a battery low status of the power supply. More specifically, when the battery percentage of the power supply apparatus 600 is lower than 10%, if the inflation-deflation apparatus 400 is performing inflation-deflation cycle on the airbag cushion 300, the control apparatus 200 pauses the inflation-deflation cycle performed by the inflation-deflation apparatus 400 on the airbag cushion 300, and inflates the inflatable and deflatable airbag region of the airbag cushion 300 first.

Figure 9:
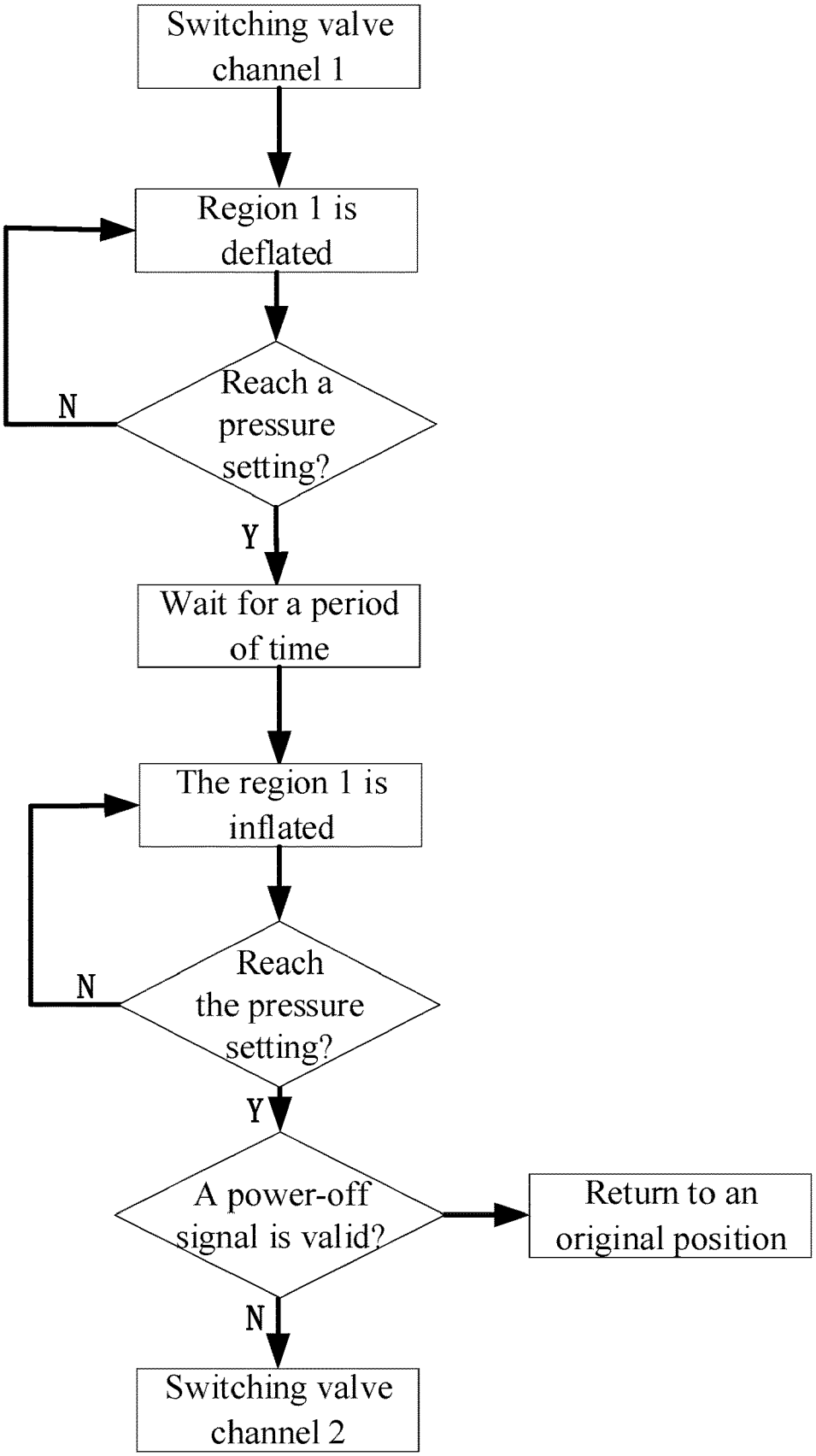
FIG. 9 is a schematic flowchart of inflating and deflating an intelligent pressure sore prevention cushion according to an embodiment of the present invention.

FIG. 9 is a schematic flowchart of inflating and deflating the intelligent pressure sore prevention cushion 10 according to an embodiment of the present invention.

The control apparatus 200 collects the air pressure in an inflatable and deflatable airbag region in the airbag cushion 300 by a pressure sensor, and controls the inflation-deflation apparatus 400 to deflate the inflatable and deflatable airbag region. The control apparatus 200 controls the switching valve 450 to open a passageway of an airbag sub-region that needs to be deflated, controls the inflation-deflation apparatus 400 to deflate the airbag sub-region, and detects, after the deflation, whether the air pressure in the airbag sub-region is less than a preset deflation threshold. If the air pressure in the airbag sub-region is greater than or equal to the preset deflation threshold, continuing to deflate the airbag sub-region. If the air pressure in the airbag sub-region is less than the preset deflation threshold, inflating the airbag sub-region after a preset time. After the inflation, the control apparatus 200 detects whether the air pressure in the airbag sub-region is greater than or equal to a preset inflation threshold. If the air pressure in the airbag sub-region is less than the preset inflation threshold, continuing to inflate the airbag sub-region. If the air pressure in the airbag sub-region is greater than or equal to the preset inflation threshold, the control apparatus 200 detects whether a power-off signal is received. If the power-off signal is received, the switching valve 450 returns to an original position. If the power-off signal is not received, the control apparatus 200 controls the switching valve 450 to switch to another airbag sub-region to perform detection on the deflation threshold and the inflation threshold. Air pressure in each airbag sub-region in the airbag cushion 300 is adjusted through an inflation-deflation cycle. The power-off signal is a signal used by the switch button to trigger the control apparatus 200 to be turned on or off.

Figure 10:
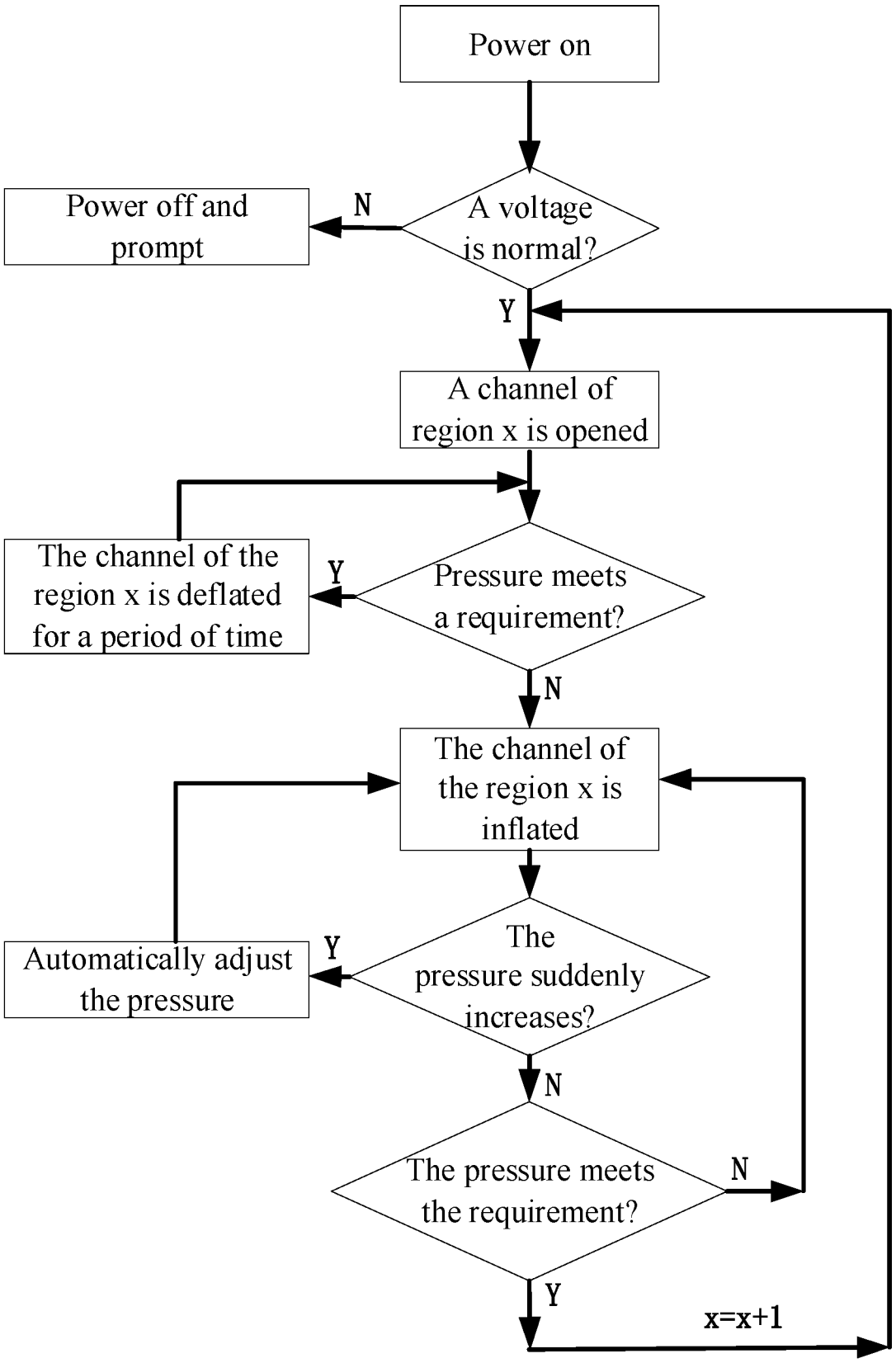
FIG. 10 is a schematic flowchart of adjusting pressure in an intelligent pressure sore prevention cushion according to an embodiment of the present invention.

FIG. 10 is a schematic flowchart of adjusting the air pressure in the intelligent pressure sore prevention cushion 10 according to another embodiment of the present invention.

When the intelligent pressure sore prevention cushion 10 is in use, a pressure sensor monitors a change in the pressure in the airbag cushion 300 in real time, and the control apparatus 200 adjusts the pressure in the airbag cushion 300 based on the change in the pressure. Specifically, the control apparatus 200 detects whether a voltage provided by the power supply apparatus 600 is normal. If the voltage provided by the power supply apparatus 600 is normal, the control apparatus 200 controls the inflation-deflation apparatus 400 to inflate the airbag cushion 300. If the voltage provided by the power supply apparatus 600 is abnormal, the intelligent pressure sore prevention cushion 10 stops operation and generates an alarm prompt. After the inflation-deflation apparatus 400 inflates the airbag cushion 300, it is detected whether the air pressure in the airbag cushion 300 is greater than a preset pressure range. If the air pressure in the airbag cushion 300 is greater than the preset pressure range, the control apparatus 200 controls the inflation-deflation apparatus 400 to deflate the airbag cushion 300. If the air pressure in the airbag cushion 300 is less than the preset pressure range, the control apparatus 200 controls the inflation-deflation apparatus 400 to inflate the airbag cushion 300. It is detected whether the air pressure in the airbag cushion 300 suddenly increases. If the air pressure in the airbag cushion 300 suddenly increases, the control apparatus 200 adjusts the pressure range based on a change in the air pressure, and the control apparatus 200 controls, based on the adjusted pressure range, the inflation-deflation apparatus 400 to inflate the airbag cushion 300. If the air pressure in the airbag cushion 300 does not suddenly increase, it is detected whether the air pressure in the airbag cushion 300 is greater than the pressure range, so that the air pressure in the airbag cushion 300 is always maintained within the preset pressure range.

The control apparatus 200 further includes the communications module 210 configured to communicate with the external device 20. The communications module 210 is configured to send environmental information to the external device 20, or receive information about the external device 20. The external device 20 monitors a status of a patient and/or a status of the intelligent pressure sore prevention cushion 10 in real time based on the environmental information, and adjusts, in time, an inflation-deflation status of the airbag cushion 300 or sends an alarm based on the status of the patient and/or the status of the intelligent pressure sore prevention cushion 10. Specifically, the communications module 210 includes the first communications unit 211 and the second communications unit 212. The first communications unit 211 is configured to communicate with the external device 20, and send the environmental information to the external device 20. The second communications unit 212 is connected to the external device 20, to obtain the information about the external device 20. In an embodiment, the first communications unit 211 is a long-distance transmission device such as General Packet Radio Service (GPRS)/Narrowband Internet of Things (NB-IoT)/3G/4G/5G, and the second communications unit 212 is a short-distance transmission device such as Bluetooth or WiFi.

The intelligent pressure sore prevention cushion 10 further includes the vital sign monitoring apparatus 500 connected to the control apparatus 200, wherein the vital sign monitoring apparatus 500 is configured to monitor vital sign information of a patient, and send the vital sign information to the control apparatus 200, so that the control apparatus 200 packages the vital signal information, and sends the vital sign information to the external device 20 by the communications module 210. The vital sign information includes, but is not limited to, an electrocardiosignal, a heart rate, breathing rate, blood pressure, or other vital sign parameters. Specifically, the vital sign monitoring apparatus 500 is connected to the second communications unit, to send the vital sign information to the control apparatus 200. The control apparatus 200 performs preliminary processing and packaging on the vital sign information, and sends the vital sign information to the external device 20 by the first communications unit 211, so that a guardian or an attending doctor can view physical sign parameters of the patient to determine the treatment effect and development of the disease, and accordingly adjust the subsequent treatment plan.

For the intelligent pressure sore prevention cushion 10, inflation-deflation adjustment is performed on the airbag cushion 300 on the intelligent pressure sore prevention cushion 10 based on the environmental information obtained by the environment monitoring apparatus 100, to adjust a stress point of local tissues of the patient, thereby enhancing the pressure sore prevention effect. In addition, the inflation-deflation apparatus 400 and the control apparatus 200 are accommodated in the airbag cushion 300, to reduce the size and weight, and improve the portability of the intelligent pressure sore prevention cushion 10.

Figure 11:
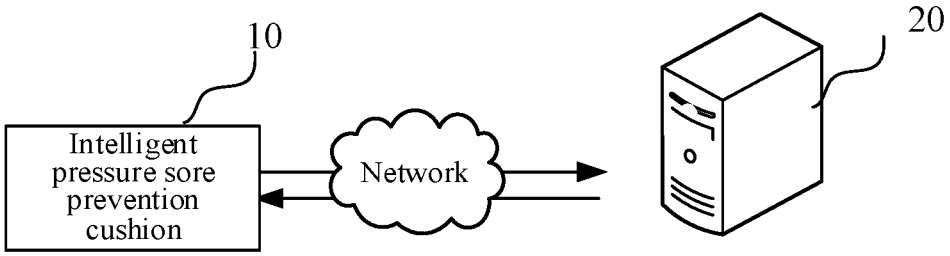
FIG. 11 is a schematic structural diagram of a monitoring system according to an embodiment of the present invention.

As shown in FIG. 11, a monitoring system includes the intelligent pressure sore prevention cushion 10 described above and the external device 20. The intelligent pressure sore prevention cushion 10 is connected to the external device 20. The intelligent pressure sore prevention cushion 10 sends environmental information and/or vital sign information to the external device 20. Based on the environmental information and/or the vital sign information, the external device 20 controls the intelligent pressure sore prevention cushion 10 to send an alarm prompt and/or to adjust air pressure in the airbag cushion 300. The intelligent pressure sore prevention cushion 10 is connected to the external device 20, to send the environmental information to the external device 20. The external device 20 generates a corresponding alarm prompt based on the environmental information. The external device 20 may be a server and/or a terminal. The terminal includes devices such as a computer, a notebook computer, a tablet computer, and a mobile phone. Specifically, the intelligent pressure sore prevention cushion 10 is connected to the external device 20 in two modes. In the first mode, the intelligent pressure sore prevention cushion 10 and the external device 20 are connected to the server, namely, the environmental information is sent to the server, and the server forwards the environmental information to the terminal. In the second mode, the intelligent pressure sore prevention cushion 10 and the external device 20 are connected to the terminal, namely, the environmental information is sent to the terminal. In an embodiment, the external device 20 is a personal computer with a display interface. The environmental information is displayed on the display interface. The environmental information is classified into three categories: non-life-threatening information, non-life-threatening information within a short time, and life-threatening information. For the non-life-threatening information, for example, if the temperature and humidity slightly increase to be higher than a prompt threshold, an indicator light prompts and the air pressure in the airbag cushion 300 is adjusted, to reduce the temperature and humidity of air between the patient and the intelligent pressure sore prevention cushion 10. For the non-life-threatening information within a short time, such as patient incontinence, if the temperature and humidity signal rise sharply, and the temperature and humidity are greater than an alarm threshold, an alarm is generated, and the non-life-threatening information within a short time is marked in yellow on the display interface. For the life-threatening information, such as apnoea or a sharp drop in body temperature, the life-threatening information is marked in red on the display interface, and a guardian of the patient is automatically dialed. If the guardian answers, follow an instruction of the guardian. If the guardian does not answer, directly dial an emergency telephone number for emergency services.

For the airbag cushion assembly, the intelligent pressure sore prevention cushion 10, and the monitoring system, the exhaust port 431 of the exhaust pipe 430 is provided in the airbag gap of the airbag cushion 300. When the airbag cushion 300 is deflated, the air is exhausted through the exhaust port 431 to take away damp air accumulated between the patient and the airbag cushion 300 through the airbag gap, to reduce humidity of the contact area between the patient and the airbag cushion 300, thereby achieving a pressure sore prevention effect. The switching valve 450 is disposed, and the motor 440 drives the switching valve 450 to open the passageway between the air pump 410 and different airbag sub-regions, which facilitates the inflation and deflation adjustment on different airbag sub-regions, and reduces the power consumption, size, and weight.

The technical features of the foregoing embodiments can be arbitrarily combined. To simplify the descriptions, all possible combinations of the technical features in the foregoing embodiments have not been described. However, as long as there is no contradiction between the combinations of these technical features, the combinations shall fall within the scope of the present invention.

The foregoing embodiments only express several implementations of the present invention. Descriptions of the foregoing implementations are relatively specific and detailed, but cannot be construed as limiting the scope of the present invention. It should be noted that, for those having ordinary skill in the art, without departing from the concept of the present invention, modifications and improvements can be further made, and these modifications and improvements shall fall within the scope of protection of the present invention. Therefore, the scope of protection of the present invention shall be subject to the appended claims.

What is claimed is:

1. An airbag cushion assembly, comprising:

an airbag cushion and an inflation-deflation apparatus, wherein the inflation-deflation apparatus communicates with the airbag cushion, the airbag cushion comprises a plurality of sub-airbags, and an airbag gap is formed between adjacent sub-airbags of the plurality of sub-airbags, and the inflation-deflation apparatus is provided with at least one exhaust port, the at least one exhaust port is provided in the airbag gap, and the inflation-deflation apparatus is configured to inflate and deflate the airbag cushion with air such that said air is expelled through the at least one exhaust port when the airbag cushion is deflated, wherein the inflation-deflation apparatus comprises an air pump, an inflation-deflation pipe, and an exhaust pipe, wherein the at least one exhaust port is provided on the exhaust pipe;

the air pump communicates with the airbag cushion through the inflation-deflation pipe, and the air pump is configured to inflate and deflate the airbag cushion;

the exhaust pipe is disposed in the airbag gap, and the inflation-deflation pipe communicates with an external environment through the exhaust pipe;

the inflation-deflation apparatus further comprises a second switch mechanism, the air pump separately communicates with the airbag cushion and the external environment by the second switch mechanism to inflate and deflate the airbag cushion; and wherein the second switch mechanism comprises a first three-way valve and a second three-way valve, and the second switch mechanism has a first state and a second state;

in the first state, the air pump communicates with the external environment by the first three-way valve, the air pump communicates with the airbag cushion by the second three-way valve, and the inflation-deflation apparatus is in an inflating state; and in the second state, the air pump communicates with the airbag cushion by the first three-way valve, the air pump communicates with the exhaust pipe by the second three-way valve, and the inflation-deflation apparatus is in a deflating state.

2. An airbag cushion assembly, comprising:

an airbag cushion and an inflation-deflation apparatus, wherein the inflation-deflation apparatus communicates with the airbag cushion, the airbag cushion comprises a plurality of sub-airbags, and an airbag gap is formed between adjacent sub-airbags of the plurality of sub-airbags, and the inflation-deflation apparatus is provided with at least one exhaust port, the at least one exhaust port is provided in the airbag gap, and the inflation-deflation apparatus is configured to inflate and deflate the airbag cushion, wherein the inflation-deflation apparatus comprises an air pump, an inflation-deflation pipe, and an exhaust pipe, wherein the at least one exhaust port is provided on the exhaust pipe;

the air pump communicates with the airbag cushion through the inflation-deflation pipe, and the air pump is configured to inflate and deflate the airbag cushion; and the exhaust pipe is disposed in the airbag gap, and the inflation-deflation pipe communicates with an external environment through the exhaust pipe, wherein the inflation-deflation apparatus further comprises a second switch mechanism, the air pump separately communicates with the airbag cushion and the external environment by the second switch mechanism to inflate and deflate the airbag cushion, wherein, the second switch mechanism comprises a first three-way valve and a second three-way valve, and the second switch mechanism has a first state and a second state;

in the first state, the air pump communicates with the external environment by the first three-way valve, the air pump communicates with the airbag cushion by the second three-way valve, and the inflation-deflation apparatus is in an inflating state; and in the second state, the air pump communicates with the airbag cushion by the first three-way valve, the air pump communicates with the exhaust pipe by the second three-way valve, and the inflation-deflation apparatus is in a deflating state.

3. The airbag cushion assembly according to claim 2, wherein the airbag cushion is provided with a first-direction airbag gap and a second-direction airbag gap, and the first-direction airbag gap and the second-direction airbag gap intersect;

a quantity of the at least one exhaust port is at least two; and the exhaust pipe is disposed in the first-direction airbag gap and/or the second-direction airbag gap, and the at least one exhaust port is provided at an intersection of the first-direction airbag gap and the second-direction airbag gap.

4. The airbag cushion assembly according to claim 2, wherein the inflation-deflation apparatus further comprises a first switch mechanism, and the first switch mechanism is disposed on the exhaust pipe; and the first switch mechanism is configured to open or close a passageway between the airbag cushion and the exhaust pipe.

5. The airbag cushion assembly according to claim 2, wherein the airbag cushion comprises an inflatable and deflatable airbag region, and the inflatable and deflatable airbag region comprises a plurality of airbag sub-regions, wherein the plurality of airbag sub-regions do not communicate with each other; the inflation-deflation apparatus further comprises a motor and a switching valve connected to the motor, and the motor is configured to drive the switching valve to open a passageway between the air pump and each airbag sub-region of the plurality of airbag sub-regions.

6. The airbag cushion assembly according to claim 5, wherein the switching valve comprises a main port and a plurality of auxiliary ports, and the inflation-deflation pipe comprises a main pipe and an auxiliary pipe, wherein the main pipe communicates with the main port, and the auxiliary pipe communicates with the plurality of auxiliary ports; and the main port of the switching valve communicates with the air pump through the main pipe, and the plurality of auxiliary ports of the switching valve correspondingly communicate with the plurality of airbag sub-regions through the auxiliary pipe.

7. An intelligent pressure sore prevention cushion, comprising the airbag cushion assembly according to claim 2, an environment monitoring apparatus, and a control apparatus; wherein the airbag cushion assembly and the environment monitoring apparatus are separately connected to the control apparatus;

the environment monitoring apparatus is configured to collect environmental information; and the control apparatus is configured to control, based on the environmental information, the inflation-deflation apparatus to perform inflation and deflation.

8. The intelligent pressure sore prevention cushion according to claim 7, wherein the environment monitoring apparatus comprises at least one selected from the group consisting of a weight sensor, a pressure sensor, a temperature sensor, and a humidity sensor.

9. The intelligent pressure sore prevention cushion according to claim 7, further comprising a vital sign monitoring apparatus connected to the control apparatus, wherein the vital sign monitoring apparatus is configured to monitor vital sign information of a patient, and send the vital sign information to the control apparatus; and the control apparatus controls the airbag cushion assembly based on the vital sign information.

10. A monitoring system, comprising the intelligent pressure sore prevention cushion according to claim 7, and an external device; wherein the intelligent pressure sore prevention cushion is connected to the external device;

the intelligent pressure sore prevention cushion sends the environmental information to the external device; and the external device controls the intelligent pressure sore prevention cushion based on the environmental information.

11. The intelligent pressure sore prevention cushion according to claim 7, wherein the airbag cushion is provided with a first-direction airbag gap and a second-direction airbag gap, and the first-direction airbag gap and the second-direction airbag gap intersect;

a quantity of the at least one exhaust port is at least two; and the exhaust pipe is disposed in the first-direction airbag gap and/or the second-direction airbag gap, and the at least one exhaust port is provided at an intersection of the first-direction airbag gap and the second-direction airbag gap.

12. The intelligent pressure sore prevention cushion according to claim 7, wherein the inflation-deflation apparatus further comprises a first switch mechanism, and the first switch mechanism is disposed on the exhaust pipe; and the first switch mechanism is configured to open or close a passageway between the airbag cushion and the exhaust pipe.

13. The intelligent pressure sore prevention cushion according to claim 7, wherein the airbag cushion comprises an inflatable and deflatable airbag region, and the inflatable and deflatable airbag region comprises a plurality of airbag sub-regions, wherein the plurality of airbag sub-regions do not communicate with each other; the inflation-deflation apparatus further comprises a motor and a switching valve connected to the motor, and the motor is configured to drive the switching valve to open a passageway between the air pump and each airbag sub-region of the plurality of airbag sub-regions.

14. The intelligent pressure sore prevention cushion according to claim 13, wherein the switching valve comprises a main port and a plurality of auxiliary ports, and the inflation-deflation pipe comprises a main pipe and an auxiliary pipe, wherein the main pipe communicates with the main port, and the auxiliary pipe communicates with the plurality of auxiliary ports; and the main port of the switching valve communicates with the air pump through the main pipe, and the plurality of auxiliary ports of the switching valve correspondingly communicate with the plurality of airbag sub-regions through the auxiliary pipe.

15. The intelligent pressure sore prevention cushion according to claim 7, wherein the environment monitoring apparatus comprises at least one selected from the group consisting of a weight sensor, a pressure sensor, a temperature sensor, and a humidity sensor.

* * * * *